US005199896A

United States Patent [19]

Mosquera

[11] Patent Number: 5,199,896

[45] Date of Patent: Apr. 6, 1993

[54] LATCHABLE P.C. BOARD CONNECTOR

[75] Inventor: Rene A. Mosquera, Laguna Niguel, Calif.

[73] Assignee: ITT Corporation, Secaucus, N.J.

[21] Appl. No.: 736,994

[22] Filed: Jul. 29, 1991

[51] Int. Cl.[5] ..... H01R 13/74

[52] U.S. Cl. ..... 439/329; 29/842; 439/557

[58] Field of Search ..... 439/329, 248, 535, 554, 439/557, 567; 29/842

[56] References Cited

U.S. PATENT DOCUMENTS

| | | | |
|---|---|---|---|
| 2,911,575 | 11/1959 | Roberts | 439/557 X |
| 3,432,802 | 3/1969 | Ritchie | 339/128 |
| 3,436,715 | 4/1969 | Matthews | 339/17 |
| 3,500,288 | 3/1970 | Startin et al. | 339/17 |
| 3,514,743 | 5/1970 | Schantz | 339/128 |
| 3,680,035 | 7/1972 | Teagno et al. | 339/59 |
| 3,744,009 | 7/1973 | Teagno et al. | 339/128 |
| 4,060,295 | 11/1977 | Tomkiewicz | 339/17 |
| 4,072,387 | 2/1978 | Sochor | 339/91 |
| 4,297,769 | 11/1981 | Coules | 174/138 |
| 4,477,142 | 10/1984 | Cooper et al. | 339/125 |
| 4,588,854 | 5/1986 | Bailey et al. | 174/52 |
| 4,639,063 | 1/1987 | Mueller | 339/75 |
| 4,687,276 | 8/1987 | Stockmaster | 439/557 |
| 4,826,441 | 5/1989 | Palmer, III | 439/79 |
| 4,924,561 | 5/1990 | Yoneyama | 439/557 X |

FOREIGN PATENT DOCUMENTS

| | | | |
|---|---|---|---|
| 2917624 | 11/1980 | Fed. Rep. of Germany . | |
| 1423909 | 11/1965 | France | 439/554 |
| 1561893 | 3/1969 | France . | |
| WO/9104592 | 4/1991 | PCT Int'l Appl. . | |
| 2218866 | 11/1989 | United Kingdom . | |

*Primary Examiner*—Eugene F. Desmond
*Attorney, Agent, or Firm*—Thomas L. Peterson

[57] ABSTRACT

A connector is described that includes a housing (30, FIG. 1 ) with a latch (34, 36) at each end which can project through a corresponding hole (20, 22) in a circuit board to releasably hold the connector to the board. Each latch has a largely U-shaped arm (40) with a pair of largely parallel arm parts (42, 44) joined by a lower part (46). The arm parts are biased apart but can be resiliently deflected together to pass the lower portion of the arm into a circuit board hole (20), until an upwardly-facing shoulder (50) on one of the arms snaps below the lower face of the circuit board to prevent removal of the latch. The latch can be removed by squeezing the arm parts together so the part forming the shoulder (50) can be pulled up through the hole. The shoulder has a far edge which lies further from the other arm part, with the far edge having a radius of curvature no more than about twice the radius (R) of the circuit board hole, to provide a shoulder of large area while enabling the shoulder to pass through the hole with only moderate squeezing together of the arm parts.

14 Claims, 5 Drawing Sheets

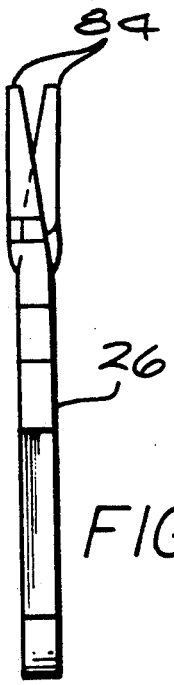
FIG. 10
FIG. 11
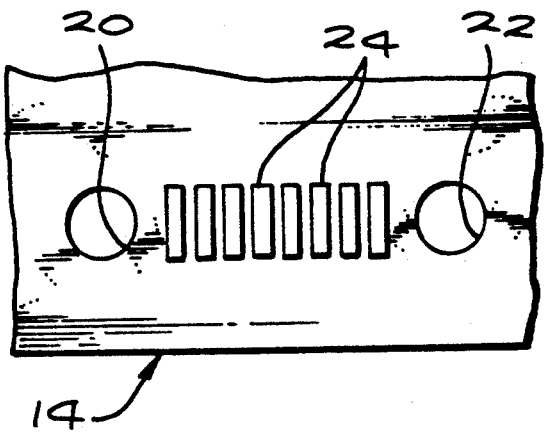
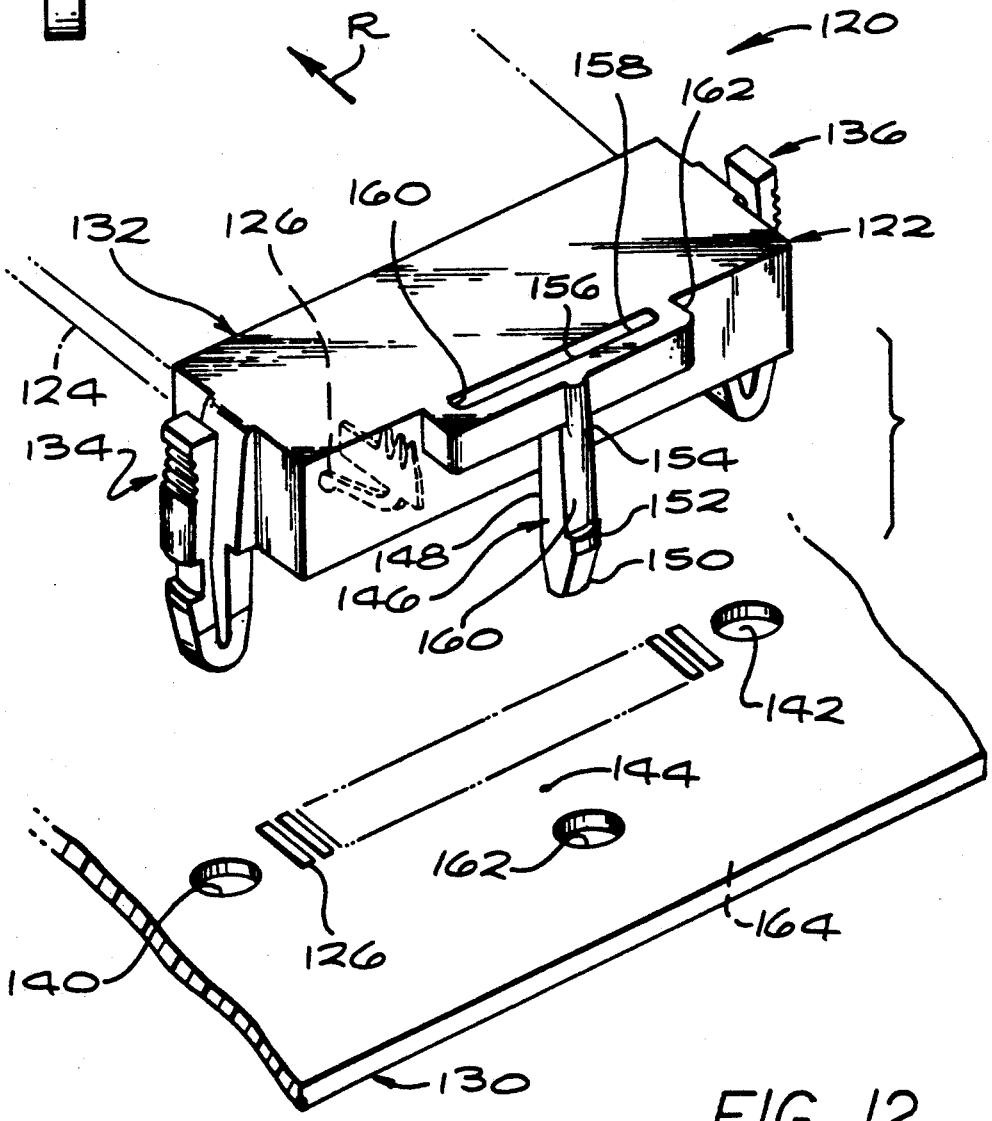
FIG. 12

LATCHABLE P.C. BOARD CONNECTOR

BACKGROUND OF THE INVENTION

One type of connector that has been used to connect the wires of a ribbon cable to conductive traces on a circuit board, includes multiple terminals that are each terminated to one of the wires. Each terminal includes a deflectable arm that engages one of the conductive traces on the circuit board when the connector is pressed against the board. U.S. Pat. No. 4,060,295 shows an early system of this type. Present systems of this type require a pair of slots in the circuit board with wide first ends through which latch arms of the connector can project, and narrower second ends which receive the latch arms as the connector is slid a short distance along the board to its final position. Such an arrangement has the advantage that the connector can be removed from the top of the circuit board, by sliding the connector rearwardly until the latch arms can be pulled out of the wide first ends of the slots. However, the need for a customer who buys the connector, to form elongated slots in the circuit board, especially slots with different portions of different widths, makes it inconvenient for customers to use such connectors. A connector which could be attached and later detached from a circuit board, in a simple manner and from the top of the board, and which required minimal and easily made alterations to the circuit board, would be of considerable value.

SUMMARY OF THE INVENTION

In accordance with one embodiment of the present invention, a connector is provided that can be easily attached and detached from a circuit board. The connector includes a housing with at least one latch that can attach to the circuit board by projecting the latch through a hole in the board. The latch has a largely U-shaped arm with a pair of largely parallel arm parts and a lower part joining the bottom of the arm parts. The arm parts are biased apart but are resiliently deflectable together. One of the arm parts forms a largely upwardly-facing shoulder that can snap under the lower surface of the circuit board when the lower portion of the arm is inserted into the circuit board hole. Withdrawal of the latch is achieved by squeezing together upper locations of the arm parts, so the shoulder of one arm part and the other arm part can pass up through the circuit board hole.

The hole in the circuit board is preferably round, so it can be formed by simple drilling. The shoulder preferably has a far edge lying furthest from the other arm part, with the far edge having a radius of curvature no more than about twice the radius of the hole. This provides a wide area of contact of the shoulder with the board, while allowing the arm to be withdrawn with only moderate squeezing together of the arm parts. For a connector having a large number of terminals pressing down against the circuit board, so there is a large distance between opposite ends of the connector, the connector can be provided with a third latch lying at one side of the connector and insertable into a hole in the board until a shoulder on the third latch engages the lower surface of the board. The third latch minimizes bowing of the circuit board arising from the downward forces of the terminals against the traces on the board.

The novel features of the invention are set forth with particularity in the appended claims. The invention will be best understood from the following description when read in conjunction with the.. accompanying drawings.

BRIEF DESCRIPTION OF DRAWINGS

FIG. 10 is a front elevation view of the terminal of FIG. 8.

FIG. 11 is a plan view of the circuit board of FIG. 1.

FIG. 12 an isometric view of a connector system constructed in accordance with another embodiment of the invention.

DESCRIPTION OF THE PREFERRED EMBODIMENTS

Figure 1:
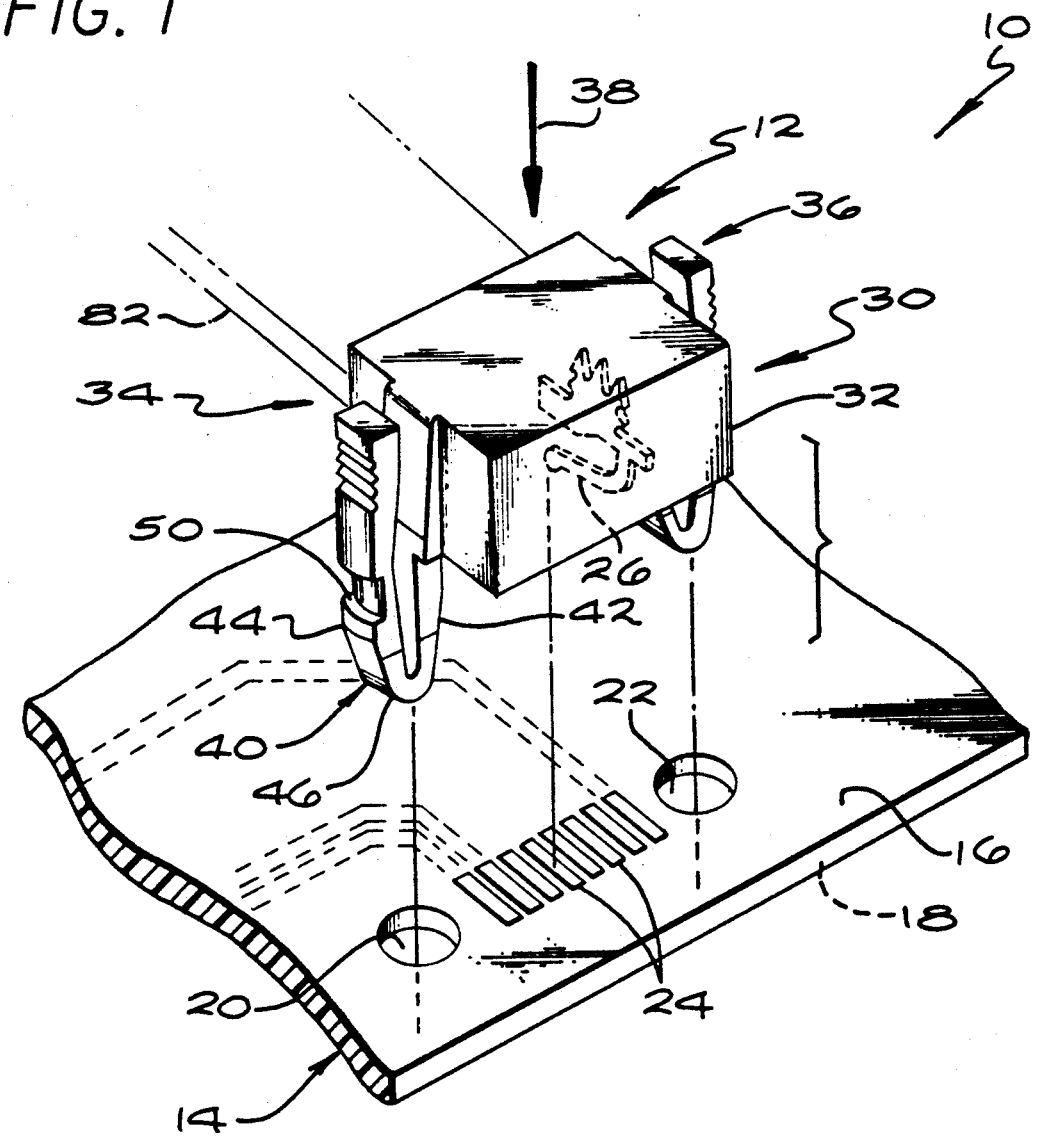
FIG. 1 is an isometric view of a connector system constructed in accordance with one embodiment of the present invention, with the connector lying a distance above the circuit board.

FIG. 1 illustrates a connector system 10 which includes a connector 12 designed to be mounted on a circuit board 14. The circuit board has upper and lower faces or surfaces 16, 18 and has a pair of holes 20, 22 that extend through the thickness of the board between its opposite surfaces. The board has a row of conductive traces 24 exposed on its upper surface, which can be contacted by terminals 26 of the connector. The connector has a housing 30 with a main housing portion 32 that holds the terminals 26, and with a pair of latches 34, 36 that can releasably attach the connector to the circuit board when the connector is moved downwardly in the engage direction 38 towards the board. Although applicant uses terms such as "downwardly", "horizontally",. etc. which indicate directions with respect to the Earth's gravity to facilitate the description of the invention, it should be understood that the connector system can be used in any orientation with respect to gravity.

Figure 2:
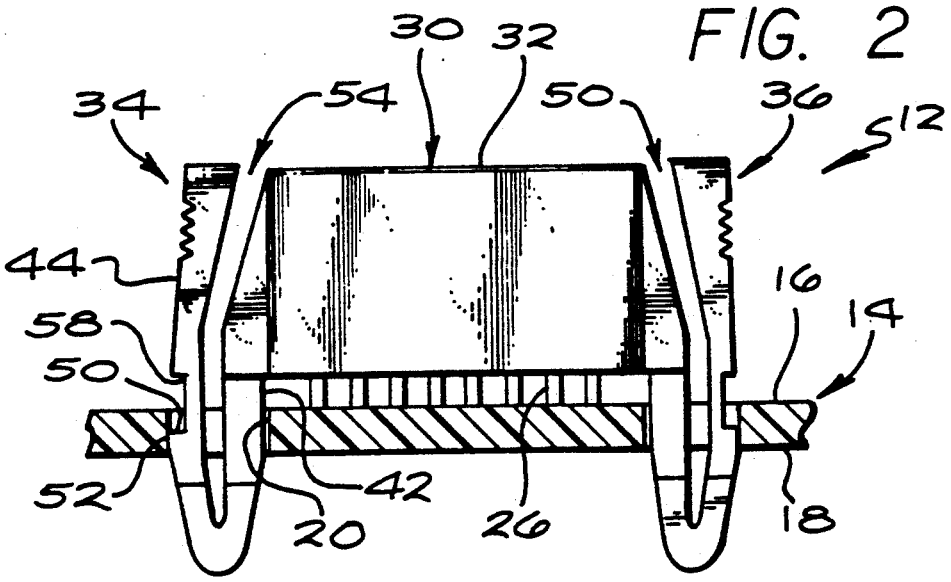
FIG. 2 is a partially sectional front elevation view of the system of FIG. 1, showing the connector during its installation circuit board.
Figure 3:
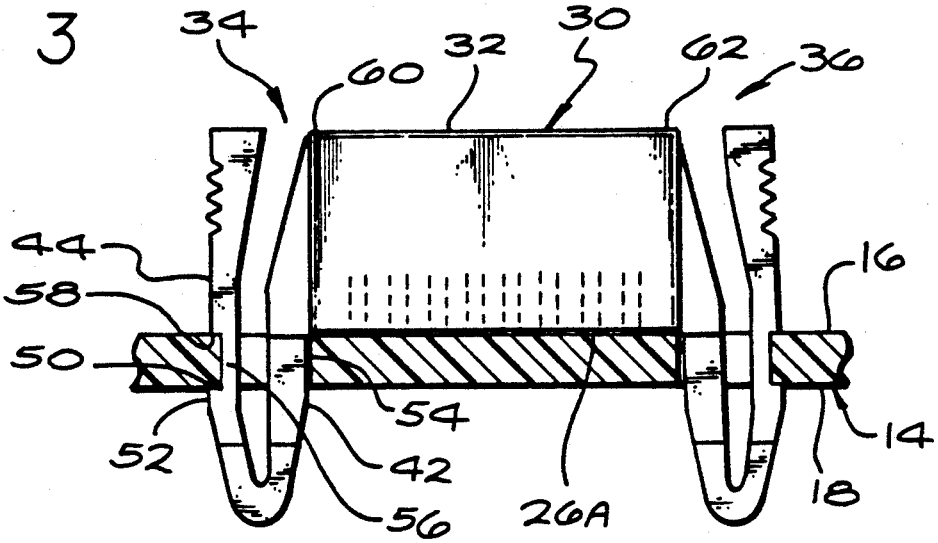
FIG. 3 view similar to that of FIG. 2, but showing the connector fully installed on the circuit board.

Each of the latches such as the first latch 34 has a largely U-shaped arm 40 with inner and outer largely parallel arm parts 42, 44 and with a lower part 46 joining the bottoms of the arm parts. As shown in FIG. 2, the pair of arm parts 42, 44 can be deflected towards each other so the latch can be inserted through the hole 20. Most of the deflection occurs in the lower part 46 and outer arm part 44. As shown in FIG. 3, when the latch 34 has been fully inserted, a shoulder 50 on a lower location 52 of the outer arm part 44 lies against the lower surface 18 of the circuit board, to prevent upward movement of the fully installed connector. A pair of mid locations 54, 56 lying respectively on the inner and outer arm parts, lie within the circuit board hole. Applicant also provides a downwardly-facing upper shoulder 58 which lies adjacent to the upper surface 16 of the circuit board to prevent any further downward movement of the connector. The two latches 34, 36 are identical, and each one holds an opposite end 60, 62 of the main housing portion 32 of the connector to the circuit board.

Figure 9:
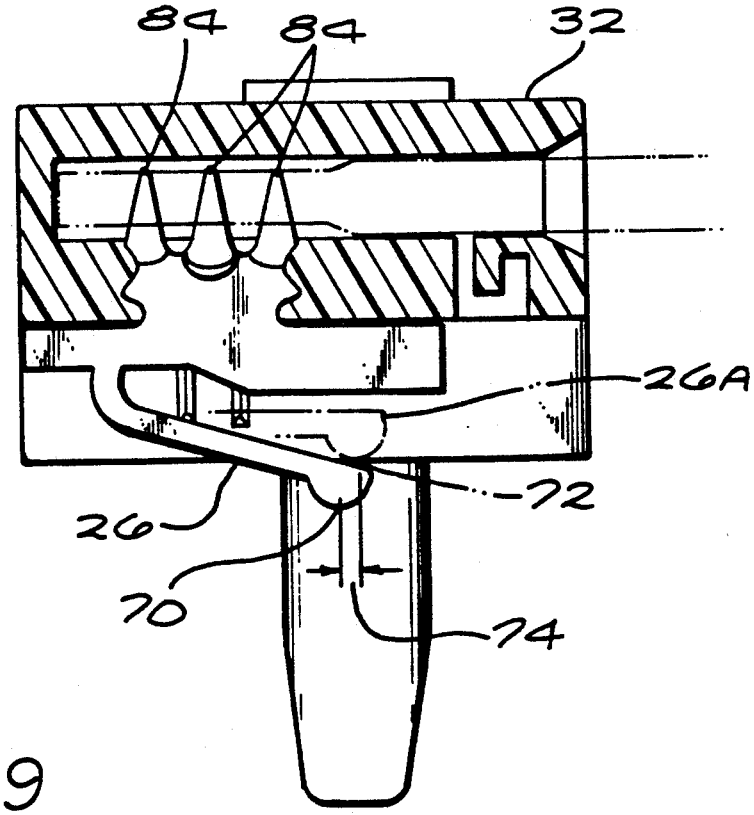
FIG. 9 is a view similar to that of FIG. 8, but showing the terminal fully installed in the connector housing.
Figure 6:
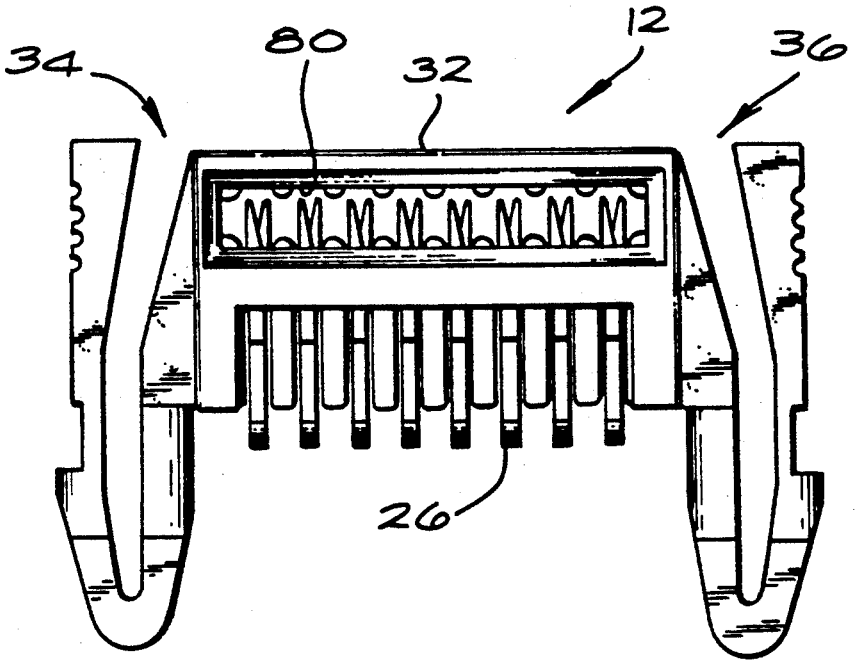
FIG. 6 is a rear elevation view of the connector of FIG. 1.
Figure 7:
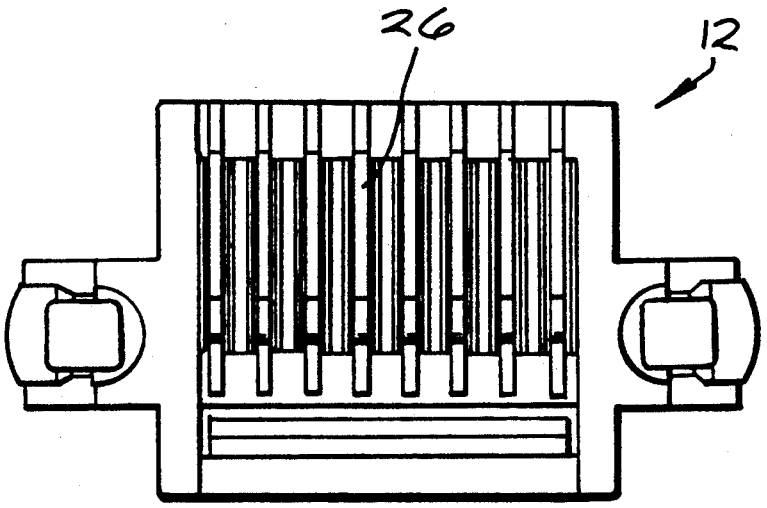
FIG. 7 is a bottom view of the connector of FIG. 6.

FIG. 2 shows the connector when it has been moved downwardly far enough that the terminals 26 first engage the conductive traces on the circuit board. As the connector is further moved downwardly to its final position shown in FIG. 3, the terminals are deflected upwardly with respect to the connector housing 30. FIG. 9 shows, in solid lines, the terminal 26 fully installed on the main housing portion 32, but before the connector is fully installed on the circuit board. Initially, when the connector is partially installed in the position of FIG. 2, a point 70 (FIG. 9) on an arm of the terminal engages a conductive trace on the circuit board. As the connector is moved further downwardly to its final position, the arm on the terminal is deflected until the terminal reaches the position 26A, wherein a point 72 engages the conductive trace on the circuit board. During such downward movement of the connector, contact of the terminal shifts by a distance 74, which produces some wiping action against the circuit board trace, to assure a good electrical connection of the terminal with the circuit board conductive trace even if the conductive trace is formed of a non noble metal such as a tin-lead alloy.

Figure 8:
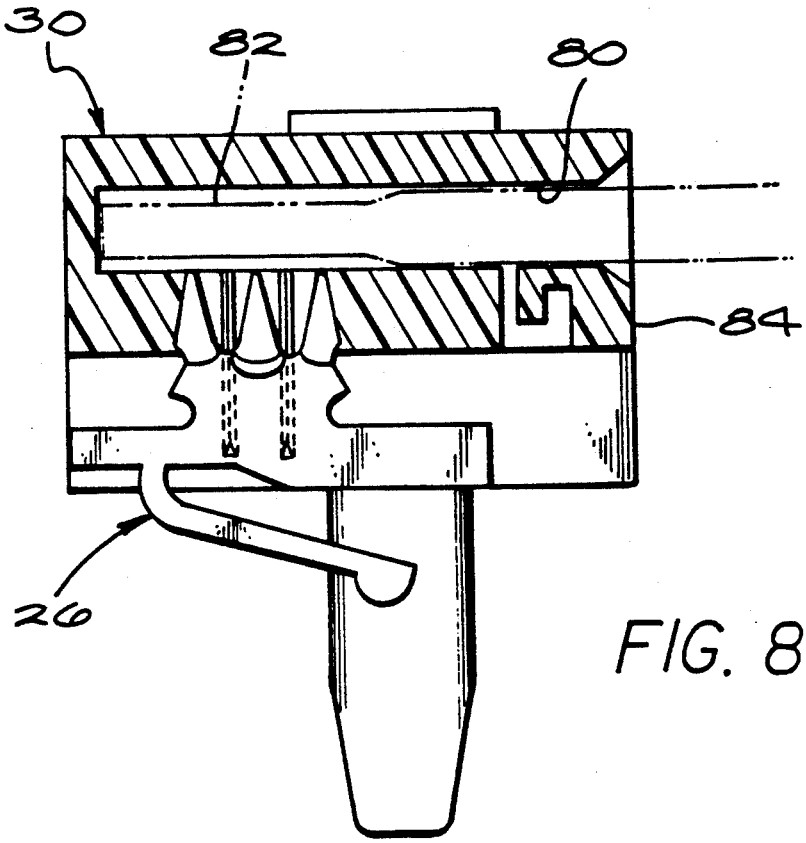
FIG. 8 is a sectional view of the connector of FIG. 6, showing a terminal prior to its full installation in the connector housing.

FIG. 8 is a view of the connector as it is supplied by the manufacturer to the customer. The terminal 26 is only partially installed on the housing 30, so a slot 80 in the housing is open to enable the end of a ribbon cable 82 or other wire arrangement to be inserted into the slot from a rear side 84 of the housing. Then, the terminals 26 are pushed upwardly to the position shown in FIG. 9. During such upward movement of the terminal, insulation displacing tangs 84 on the terminal engage the conductive core of a wire of the ribbon cable. Such terminals and their manner of mounting in the housing is known in the prior art.

Figure 4:
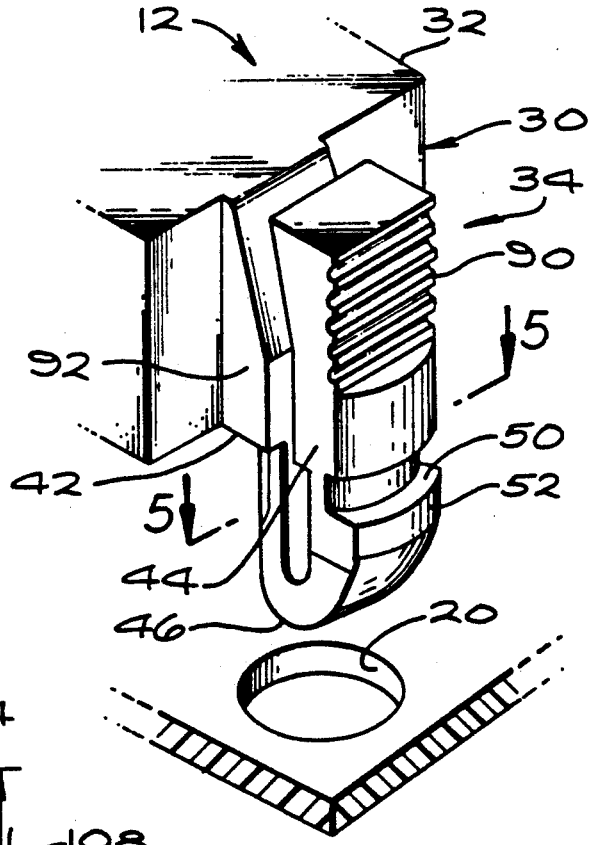
FIG. 4 is an isometric view of one of the latches of the connector of FIG. 1.
Figure 5:
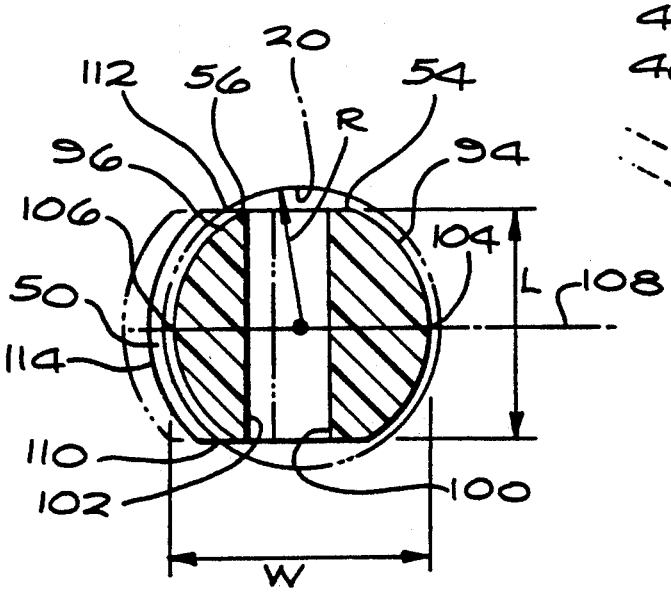
FIG. 5 is a sectional view taken on the line 5—5 of FIG. 4.

FIGS. 4 and 5 illustrate details of the latch 34 which can enter a circuit board hole 20 and hold down the connector to the circuit board. The outer arm part 44 has an upper handle portion 86 lying above the shoulder 50 and forming a press pad 90 which can be gripped by one finger of a hand while the press pad of the opposite latch (36) is gripped by another finger, with the press pads pressed towards each other to deflect the inner and outer arm parts 42, 44 together. It is noted that the top 92 of the inner arm part is fixed to the main housing portion 32 of the connector housing 30. During squeezing of the press pads, most of the arm deflection occurs at or near the lower part 46 that connects the inner and outer arm parts. The arm parts must be deflected together sufficiently for the shoulder-forming lower location 52 and a corresponding part of the inner arm part to pass downwardly through the hole 20. When the press pads are released, the lower location 52 springs away from the inner arm part so the shoulder 50 lies under the lower surface of the circuit board. It can be seen in FIGS. 3 and 4, that the press pad 90 lies above the shoulder 50 by more than twice the thickness of the circuit board 14. Also, no other part of the connector blocks access to the press pad 90 by the finger of a person's hand, which facilitates installation and any removal of the connector from the circuit board.

As shown in FIG. 5, the inner and outer mid locations 54, 56 have far sides 94, 96 that are furthest from each other and near sides 100, 102 that are closest to each other. Each far side has a far location 104, 106 at the middle of the far side, with the far locations lying on or close to an imaginary line 108 extending in the direction in which the arm parts can be squeezed to move towards one another. Each far side 94, 96 is preferably convex, so the far locations 104, 106 lie adjacent to the walls of the circuit board hole 20, resulting in each mid location being as thick or wide as possible in the direction W for maximum strength. It is noted that the far side 94 generally lies spaced from the walls of the hole. The near sides 100, 102 are preferably straight to enable maximum deflection of the arm parts towards each other. The length L of the arm at the mid location is preferably greater than the radius R of the hole, and the opposite ends 110, 112 of the far side 96 preferably lie adjacent to the walls of the hole. This results in the latches resisting movement of the latches and connector parallel to the direction L, to provide stability in connector position on the circuit board.

The shoulder 50 has a far edge 114 that preferably has a radius of curvature that is about the same as that of the circuit board hole, this is, no more than twice as great as R. This provides a large area of abutment of the shoulder 50 with the circuit board, while allowing the shoulder to fit into the hole 20 with only moderate squeezing together of the arm parts and their mid locations 54, 56.

FIG. 12 illustrates another connector system 120 which is designed for use with a connector 122 that has a large number of terminals 126, each of the same type as the terminals 26 shown in FIG. 1. While the connector 12 of FIG. 1 has eight terminals, the particular connector 122 in FIG. 12 has twenty-two terminals for connecting wires of a wide ribbon cable 124 to twenty-two corresponding conductive traces 126 on a circuit board 130. The connector 122 has a pair of latches 134, 136 that are of the same construction as the latches in FIG. 1. However, the main housing portion 132 on which the terminals are mounted, is much longer than the main housing portion in FIG. 1. The two latches 134, 136 are sufficient to securely hold the connector to the circuit board by attaching to parts of the circuit board lying immediately around a pair of holes 140, 142 in the circuit board. However, the much longer distance between the latches 134, 136 and a much larger number of terminals 126 that press firmly down against the circuit board, can result in bowing of the circuit board. Such bowing results in a middle portion 144 of the board being deflected downwardly with respect to the portions of the board that immediately surround the holes 140, 142.

To prevent circuit board bowing, applicant adds a third latch 146 to the connector. The latch 146 includes a primarily vertically extending arm 148 with a lower portion 150 forming an upwardly-facing shoulder 152. An upper portion 154 of the arm is mounted on the middle 156 of a horizontal beam 158. The beam has opposite ends 160, 162 mounted on the main housing portion 132, with the beam middle 156 spaced from the main housing portion. When a front surface 160 of the latch arm is pressed rearwardly while the connector is pushed down against the circuit board, the lower portion 150 deflects rearwardly, in a direction R, to allow the lower portion to pass through a third hole 162 in the circuit board. When the shoulder 152 reaches a position below the lower surface 164 of the circuit board, the lower portion 150 springs forwardly so the shoulder 152 lies against the lower surface of the board. Deflection of the lower part of the arm results by slight resilient twisting of the beam 158.

Thus, the invention provides a connector system of the type that includes a connector for mounting on a circuit board by projecting through holes in the board, wherein latches on the connector can be easily operated to install and remove the connector from the board. Each latch includes a largely U-shaped arm with largely parallel arm parts connected by a lower part. The arm parts can be deflected closer together to pass downwardly through a hole in the circuit board, until a largely upwardly-facing shoulder on one of the arm parts moves below the lower surface of the board, so mid locations on the arm parts can spring apart and allow the shoulder to abut the lower surface of the board and prevent withdrawal of the connector. Each hole in the circuit board that receives a latch, is preferably round to enable it to be formed by simple drilling. The distance between the holes is not as critical as previously, because deflection of the outer arm can accommodate circuit board holes that are slightly too close together. The upwardly-facing shoulder of each latch preferably has a far edge with a radius of curvature no more than about twice the radius of the hole, to provide wide area contact of the shoulder with the board while permitting insertion and withdrawal with only small deflection of the arm parts towards each other. Mid locations of the arm parts which lie in the hole in a fully inserted connector, preferably have convex far sides to provide mid locations of considerable width, or thickness, for high bending strength. A long connector can be provided with a third latch which includes an arm whose upper end is mounted on the middle of a beam which is mounted at only its opposite ends on a main housing portion of the connector.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector and board combination, comprising:

a circuit board that has upper and lower opposite surfaces and at least one hole extending between said surfaces;

a connector which includes a housing with a main housing portion and with at least one latch, said latch comprises a largely U-shaped arm with a pair of largely parallel arm parts and a lower part joining said arm parts;

said arm parts are resiliently deflectable toward each other, and a first of said arm parts forms a largely upwardly-facing shoulder and forms an upper handle portion extending above said shoulder by more than twice the thickness of said circuit board when said arm parts are undeflected toward each other, with said upper handle portion being freely accessible to be pressed by a person's finger without blocking by said any other portion of said connector.

2. The connector described in claim 1 wherein:

said connector has a body with opposite ends and opposite sides, and has terminals constructed to press downwardly against said upper surface of said circuit board;

said circuit board has a third hole;

said at least one latch includes a pair of identical latches at said opposite ends of said body and a third latch lying at one of said sides of said body, said third latch including an arm having a lower part constructed to project into said third hole in said circuit board, said lower part of said third latch arm forming an upwardly-facing shoulder and being deflectable to enable said shoulder of said third latch to be deflected slightly horizontally, whereby to resist downward bowing of the portion of said circuit board that lies between said first and second holes.

3. The connector described in claim 2 wherein:

said latch includes a substantially horizontal beam having opposite ends mounted on spaced locations of a first of said sides of said main housing portion, said beam having a middle which is spaced from said main housing portion to enable deflection of said beam middle, said arm having an upper end fixed to said beam middle.

4. The connector described in claim 1 wherein:

said hole in said circuit board is substantially round and has a predetermined radius;

each of said arm parts has a mid location lying slightly above the height of said upwardly-facing shoulder, with a far side of said first arm part, which lies farthest from the other arm part has a radius of curvature that is about the same as the radius of said hole in said circuit board.

5. The connector described in claim 1 wherein:

said hole in said circuit board is substantially round and has a predetermined radius;

said upwardly-facing shoulder has a radius of curvature that is about the same as the radius of said hole in said circuit board, as seen in a downwardly-looking sectional view of said arm from a location immediately above said shoulder.

6. A connection system comprising:

a circuit board having first and second opposite faces and a board region with a plurality of conductive traces on said first face, said board region having first and second holes that each extends through said board;

a connector that includes a main housing portion with opposite ends, a plurality of terminals mounted on said main housing portion for contacting said conductive traces when said main housing portion is pressed in an engage direction towards said circuit board first face, and a pair of latches that are each mounted on said main housing portion at a different one of said ends;

each latch includes an arm extending in a largely U-shape, with first and second largely parallel arm parts that can resiliently deflect together and apart, said first arm part of each latch having a shoulder facing largely opposite to said engage direction to abut a portion of said second face of said circuit board which surrounds one of said holes therein while a location on said first arm part lies in said hole.

7. The system described in claim 6 wherein:

said holes in said circuit board are each substantially circular;

said shoulder has a far edge which lies furthest from said second arm part, said far edge of said shoulder having opposite ends and a middle that lie on an imaginary circle having a radius of curvature no more than about twice the radius of a corresponding one of said holes.

8. The system described in claim 6 wherein:

said first arm part has a mid location positioned to lie in said circuit board hole when said shoulder abuts said board second face;

said hole is round, and said mid location has a far side lying furthest from said second arm part, said far side being convex.

9. A method for attaching and detaching a connector that has a main housing portion and a plurality of terminals thereon, to a circuit board that has an upper face with a plurality of conductive traces for engagement with the terminals and a lower face, characterized by:

inserting the lower end of each of a pair of U-shaped bent arms that are mounted to said main housing portion, into one of a pair of holes in said circuit board, so a pair of largely parallel arm parts of each said arm and a lower part that connects said arm parts pass down through one of said circuit board holes, until an upwardly-facing shoulder on a first of said arm parts of each arm lies under said circuit board lower face while a handle portion of each said arms extends above said circuit board upper face, including squeezing said handle portions together to resiliently deflect said arm parts together while moving said shoulder through said circuit board.

10. The system described in claim 6 wherein:

said first of said arm parts includes a handle portion extending from said first face of said circuit board.

11. A combination connector and circuit board comprising:

a circuit board that has upper and lower opposite surfaces and at least one hole extending between said surfaces;

a connector which includes a main housing portion and at least one latch;

said latch comprises a largely U-shaped arm with a pair of largely parallel arm parts and a lower part joining said arm parts, said connector being mountable on said circuit board with said arm projecting through said hole and with said arm lower part lying below said board.

said arm parts are resiliently deflectable toward each other, and a first of said arm parts forms a largely upwardly-facing shoulder that engages said circuit board lower surface and forms an upper handle portion extending above said shoulder and above said circuit board, when said connector is mounted on said circuit board, said upper handle portion being free of blockage by any other portion of said connector to allow a person to press against said handle portion when said connector is mounted on said circuit board;

a lower location on said first arm part which lies below said shoulder, is insertable into said hole by deflecting said arm parts together and moving down said arm until said shoulder lies below the lower surface of said board and can move under said board lower surface to prevent removal of said latch;

the width of said arm parts at a height immediately above said shoulder, in a direction parallel to the direction of deflection of said arm parts toward each other, is greater than the width of said hole when said arm parts are undeflected toward each other.

12. A connector for mounting on a circuit board that has upper and lower opposite surfaces and at least one hole extending between said surfaces, wherein said connector includes a housing with at least one latch, characterized by:

said latch comprises a largely U-shaped arm with a pair of largely parallel arm parts and a lower part joining said arm parts;

said arm parts are resiliently deflectable toward each other, and a first of said arm parts forms a largely upwardly-facing shoulder;

a lower location on said first arm part which lies below said shoulder, is insertable into said hole by deflecting said arm parts together and moving down said arm until said shoulder lies below the lower surface of said board and can move under said board lower surface to prevent removal of said latch;

each of said arm parts includes a mid location lying slightly above said shoulder to lie within said hole in said circuit board, with each mid location having a far side furthest from the other arm parts, with both of said far sides being convex.

13. The connector described in claim 12 wherein:

said circuit board has upper and lower surfaces, and said hole, in which lie said mid locations with convex far sides when said connector is mounted on said board, is a substantially round hole.

14. A connector for mounting on a circuit board that has upper and lower opposite surfaces and at least one hole extending between said surfaces, wherein said connector includes a housing with at least one latch, characterized by:

said latch comprises a largely U-shaped arm with a pair of largely parallel arm parts and a lower part joining said arm parts;

said arm parts are resiliently deflectable toward each other, and a first of said arm parts forms a largely upwardly-facing shoulder and forms an upper handle portion extending above said shoulder;

a lower location on said first arm part which lies below said shoulder, is insertable into said hole by deflecting said arm parts together and moving down said arm until said shoulder lies below the lower surface of said board and can move under said board lower surface to prevent removal of said latch;

said arm has a downwardly-facing shoulder lying above said upwardly-facing shoulder so the thickness of said circuit board can lie between them.

* * * * *